US007466297B2

(12) United States Patent
Pai

(10) Patent No.: US 7,466,297 B2
(45) Date of Patent: Dec. 16, 2008

(54) METHOD FOR DRIVING A TFT-LCD

(75) Inventor: Feng-Ting Pai, Hsinchu (TW)

(73) Assignee: Hannstar Display Corporation, Taipei (TW)

( * ) Notice: Subject to any disclaimer, the term of this patent is extended or adjusted under 35 U.S.C. 154(b) by 646 days.

(21) Appl. No.: 10/899,039

(22) Filed: Jul. 27, 2004

(65) Prior Publication Data

US 2005/0151712 A1 Jul. 14, 2005

(30) Foreign Application Priority Data

Jan. 14, 2004 (TW) ..... 93100935 A

(51) Int. Cl.
*G09G 3/36* (2006.01)

(52) U.S. Cl. ..... 345/89; 345/98; 345/690

(58) Field of Classification Search ..... 345/89, 345/98, 100, 690, 211, 87, 204, 589
See application file for complete search history.

(56) References Cited

U.S. PATENT DOCUMENTS 7,034,793 B2 * 4/2006 Sekiya et al. ..... 345/98
7,148,869 B2 * 12/2006 Chen et al. ..... 345/89
2002/0175907 A1 * 11/2002 Sekiya et al. ..... 345/211
2004/0012551 A1 * 1/2004 Ishii ..... 345/87
2004/0027322 A1 * 2/2004 Chen et al. ..... 345/89
2004/0140985 A1 * 7/2004 Liaw ..... 345/690
2004/0178984 A1 * 9/2004 Park et al. ..... 345/100
2005/0068343 A1 * 3/2005 Pan et al. ..... 345/690
2005/0083353 A1 * 4/2005 Maruyama et al. ..... 345/690
2005/0168430 A1 * 8/2005 Nishimura et al. ..... 345/100
2005/0219180 A1 * 10/2005 Kubo et al. ..... 345/89
2005/0225525 A1 * 10/2005 Wu et al. ..... 345/89
2006/0071936 A1 * 4/2006 Leyvi et al. ..... 345/589
2006/0103682 A1 * 5/2006 Kunimori et al. ..... 345/690
2006/0244707 A1 * 11/2006 Furihata et al. ..... 345/98

* cited by examiner

*Primary Examiner*—Amare Mengistu
*Assistant Examiner*—Jennifer Zubajlo

(57) ABSTRACT

A method for driving a TFT-LCD, includes first applying a bias voltage to a pixel so the gray level displayed by the pixel changes from an initial gray level to a baseline gray level. A target gray level voltage is then converted to a corresponding over-drive gray level voltage. Subsequently, the over-drive gray level voltage is applied to the pixel so the gray level displayed by the pixel changes from the baseline gray level to the target gray level.

20 Claims, 10 Drawing Sheets

Initial Gray Level Voltage

Target Gray Level Voltage

| Target Level \ Initial Level | 0 | 16 | 32 | 48 | 64 | 80 | 96 | 112 | 128 | 144 | 160 | 176 | 192 | 208 | 224 | 240 | 255 |
|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 |
| 16 | 32 | 16 | 0 | 0 | 0 | 0 | 0 | 0 | 0 | 0 | 0 | 0 | 0 | 0 | 0 | 0 | 0 |
| 32 | 48 | 48 | 32 | 16 | 16 | 16 | 16 | 0 | 0 | 0 | 0 | 0 | 0 | 0 | 0 | 0 | 0 |
| 48 | 80 | 64 | 64 | 48 | 32 | 32 | 32 | 16 | 16 | 16 | 0 | 0 | 0 | 0 | 0 | 0 | 0 |
| 64 | 96 | 80 | 80 | 80 | 64 | 48 | 64 | 32 | 32 | 32 | 16 | 16 | 0 | 0 | 0 | 0 | 0 |
| 80 | 112 | 96 | 96 | 96 | 96 | 80 | 80 | 64 | 48 | 48 | 32 | 32 | 16 | 16 | 0 | 0 | 0 |
| 96 | 144 | 128 | 128 | 128 | 112 | 112 | 96 | 80 | 80 | 64 | 48 | 64 | 32 | 32 | 16 | 0 | 0 |
| 112 | 160 | 144 | 144 | 160 | 144 | 128 | 128 | 112 | 96 | 96 | 80 | 80 | 48 | 48 | 32 | 0 | 0 |
| 128 | 192 | 160 | 176 | 176 | 160 | 160 | 144 | 144 | 128 | 112 | 112 | 112 | 80 | 80 | 48 | 32 | 0 |
| 144 | 208 | 176 | 176 | 208 | 192 | 192 | 160 | 176 | 160 | 144 | 128 | 128 | 112 | 96 | 80 | 48 | 16 |
| 160 | 224 | 224 | 224 | 240 | 224 | 208 | 192 | 208 | 192 | 176 | 160 | 160 | 128 | 128 | 112 | 80 | 32 |
| 176 | 240 | 240 | 240 | 255 | 240 | 240 | 208 | 224 | 224 | 208 | 192 | 176 | 160 | 160 | 128 | 96 | 48 |
| 192 | 255 | 255 | 255 | 255 | 240 | 240 | 240 | 240 | 240 | 240 | 224 | 208 | 192 | 176 | 160 | 128 | 64 |
| 208 | 255 | 255 | 255 | 255 | 255 | 255 | 255 | 255 | 240 | 240 | 224 | 240 | 224 | 208 | 176 | 160 | 80 |
| 224 | 255 | 255 | 255 | 255 | 255 | 255 | 255 | 255 | 255 | 255 | 255 | 255 | 240 | 240 | 224 | 192 | 112 |
| 240 | 255 | 255 | 255 | 255 | 255 | 255 | 255 | 255 | 255 | 255 | 255 | 255 | 255 | 255 | 255 | 240 | 160 |
| 256 | 256 | 256 | 256 | 256 | 256 | 256 | 256 | 256 | 256 | 256 | 256 | 256 | 256 | 256 | 256 | 256 | 256 |

Fig. 2 (Prior Art)

METHOD FOR DRIVING A TFT-LCD

RELATED APPLICATIONS

The present application is based on, and claims priority from, Taiwan, R.O.C. Application Serial Number 93100935, filed Jan. 14, 2004, the disclosure of which is hereby incorporated by reference herein in its entirety.

BACKGROUND

1. Field of Invention

The present invention relates to a TFT-LCD (Thin Film Transistor—Liquid Crystal Display) driving method. More particularly, the present invention relates to a TFT-LCD driving method utilizing an over-drive technique.

2. Description of Related Art

When an appropriate gray level voltage is applied to a pixel in a TFT LCD panel, the angle of liquid crystal molecule in the pixel will change correspondingly. This angle change further alters transmittance of the TFT-LCD panel so a desired gray level can be achieved. However, due to the intrinsic property of liquid crystal molecule, if the gray level has to change dramatically during two successive refresh periods, the desired angle change may not be achieved in one refresh period. This results in a blurred display, and the situation is particularly bad for a motion picture display.

One solution to this problem usually employs an over-drive technique.

The over-drive technique applies a gray level voltage higher than originally required, so the changing rate of the gray level can also be increased. FIG. 1 is a diagram illustrating the relation between the gray level and time when the over-drive technique is employed. Without employing the over-drive technique, it takes a period $T_1$ for the pixel to change from an initial gray level $L_x$ to a target gray level $L_y$. The period $T_1$ is longer than a refresh period $T_0$, which means the pixel can't change from the initial gray level $L_x$ to the target gray level $L_y$ in one refresh period. This results in a blurred display. However, by employing the over-drive technique, an over-drive gray level voltage $V_y'$ is applied to the pixel while the pixel needs to change from the initial gray level $L_x$ to the target gray level $L_y$. Since the over-drive gray level voltage $V_y'$ is higher than the target gray level voltage $V_y$ of the target gray level $L_y$, the angle change of liquid crystal molecule can be speeded. The desired angle change can therefore be achieved, and the pixel can display the target gray level $L_y$. That is, by providing an over-drive gray level voltage $V_y'$ higher than the target gray level voltage $V_y$, the changing rate from the initial gray level $L_x$ to the target gray level $L_y$ can be increased. This enables the pixel to change more rapidly from the initial gray level $L_x$ to the target gray level $L_y$.

The relation between the initial gray level voltage, the target gray level voltage, and the over-drive gray level voltage, can be obtained from a Look-Up Table. Look-Up Table is a table providing the corresponding over-drive gray level voltage when the pixel has to change from an initial gray level voltage to a target gray level voltage. FIG. 2 shows a Look-Up Table of an 8-bits driving system. The horizontal axis represents the initial gray level voltage, and the vertical axis represents the target gray level voltage. The intersection is the over-drive gray level voltage applied to the pixel. For example, if the initial gray level voltage is $V_{32}$, and the target gray level voltage is $V_{64}$, the over-drive gray level voltage applied to the pixel would be $V_{80}$.

FIG. 3 is a block diagram showing a TFT-LCD driving system utilizing the over-drive technique. Timing controller 30 retrieves $G_n$ frame image data from an image data source, and retrieves a previous $G_{n-1}$ frame image data from a frame buffer 32. Timing controller 30 then compares the $G_n$ and $G_{n-1}$ frame image data and addresses the pixels that need to be updated. Subsequently, timing controller 30 retrieves the Look-Up Table 34 stored in a memory, and converts the image data in the updated pixels to a corresponding over-drive gray level voltage. The over-drive gray level voltage is then applied to the pixel via a source driver.

However, the TFT-LCD driving system utilizing the over-drive technique still has some drawbacks. First, only the pixels where image data has to change during the two successive refresh periods will be updated. This requires several frame buffers to store the previous frame image data in order to compare the image data in the same pixel during the two successive refresh periods. However, frame buffers are expensive and dramatically increase the TFT-LCD manufacture cost. Besides, the Look-Up Table utilized in the over-drive technique is usually stored in EEPROM (Electrically Erasable Programmable Read-Only Memory). If the bits of the driving system were increased, the corresponding Look-Up Table would expand as well, and the memory capacity would also have to increase. This would further raise the manufacturing cost.

SUMMARY

Therefore, one objective of the present invention is to provide a TFT-LCD driving method.

Another objective of the present invention is to provide a TFT-LCD driving system that doesn't require a frame buffer.

Still another objective of the present invention is to provide a TFT-LCD driving system where memory capacity required for storing the Look-Up Table can be minimized.

A further objective of the present invention is to provide a TFT-LCD utilizing the over-drive technique.

In accordance with the foregoing and other objectives of the present invention, a TFT-LCD driving method utilizing the over-drive technique is proposed. A bias voltage is first applied to the pixel so the gray level displayed by the pixel changes from an initial gray level to a baseline gray level. Then a target gray level voltage is converted to a corresponding over-drive gray level voltage. Subsequently, the over-drive gray level voltage is applied to the pixel so the gray level displayed by the pixel changes from the baseline gray level to the target gray level.

In accordance with another objective of the present invention, a TFT-LCD utilizing the over-drive technique is proposed. The TFT-LCD includes a panel, a bias source, a timing controller, and a source driver. The panel comprises pixel matrix. The bias source is used for providing a bias voltage so the gray level displayed by the pixel can change from the initial gray level to a baseline gray level. The timing controller converts a target gray level voltage to a corresponding over-drive gray level voltage. The over-drive gray level voltage is then applied to the pixel via the source driver, so the gray level displayed by the pixel changes from the baseline gray level to the required target gray level.

The present invention is directed to a driving method for a TFT-LCD, which allows the pixel to achieve the desired target gray level more rapidly, and the frame buffer is no longer required in the driving system. Additionally, the memory capacity required for storing the Look-Up Table can be minimized. The overall manufacture cost can be further reduced. Moreover, the present invention can simplify the integrated circuit design and the chip size. The power consumption and the blurring effect can also be minimized. The present invention is particularly suitable for motion picture display.

BRIEF DESCRIPTION OF THE DRAWINGS

These and other features, aspects, and advantages of the present invention will become better understood with regard to the following description, appended claims, and accompanying drawings, where:

FIG. 2 is an 8-bits Look-Up Table used in the over-drive technique;

DESCRIPTION OF THE PREFERRED EMBODIMENTS

Figure 1:
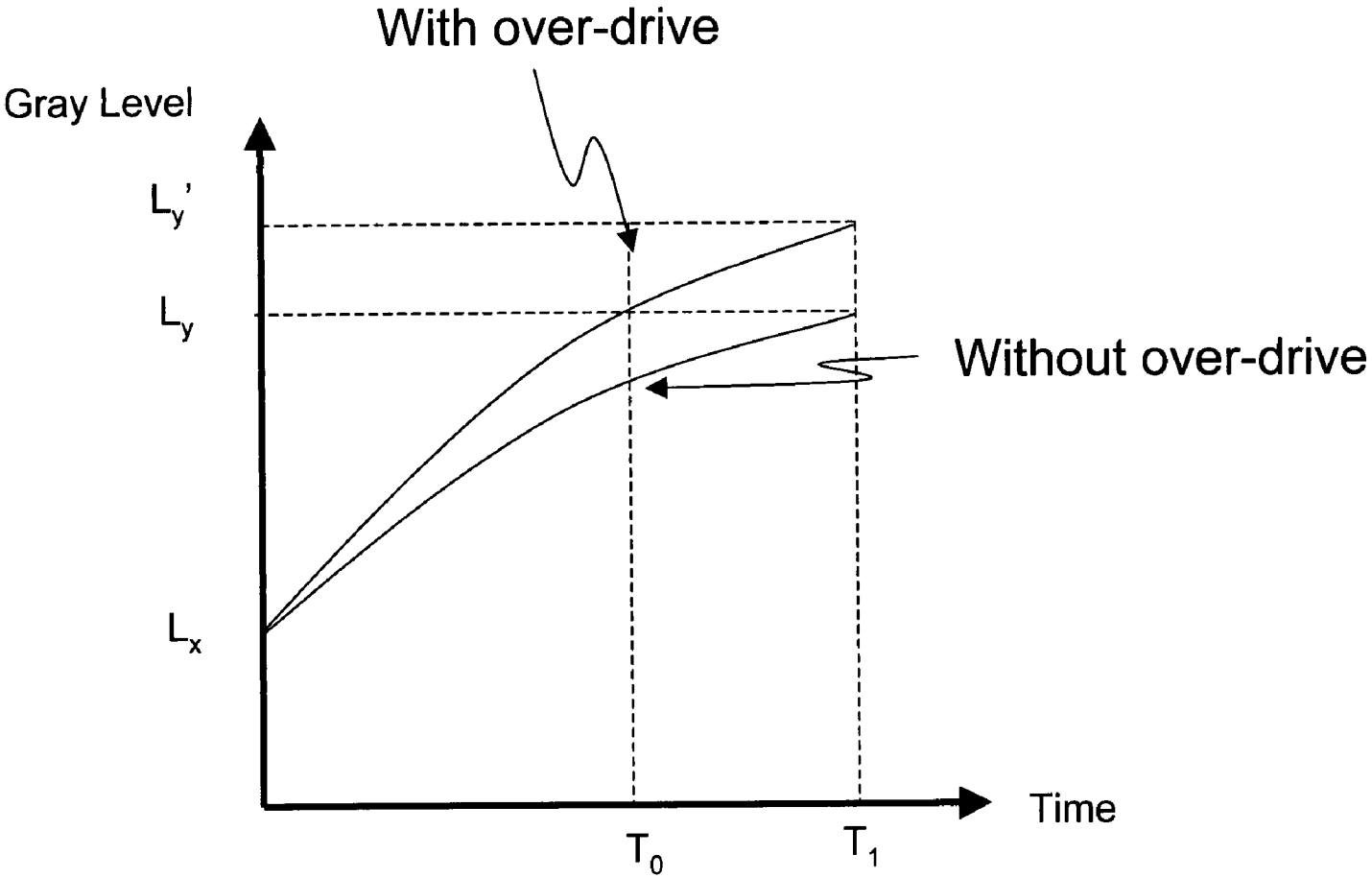
Fig. 1 (Prior Art)
FIG. 1 is a diagram showing the relation between the gray level and time while the over-drive technique is utilized.
Figure 3:
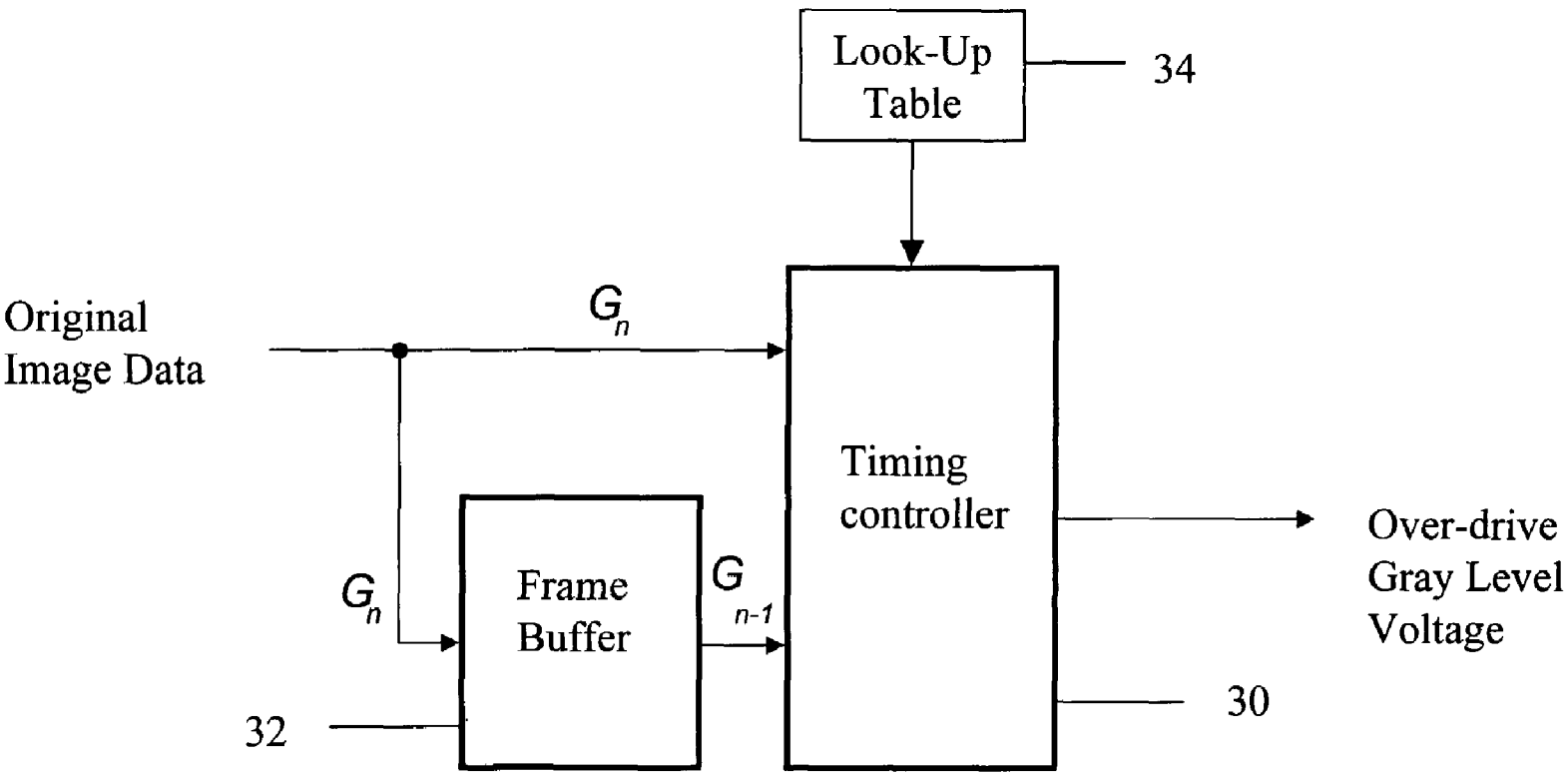
Fig. 3 (Prior Art)
FIG. 3 is a block diagram illustrating the over-drive system in the prior art.

Reference will now be made in detail to the present preferred embodiments of the invention, examples of which are illustrated in the accompanying drawings. Wherever possible, the same reference numbers are used in the drawings and the description to refer to the same or like parts.

Figure 4:
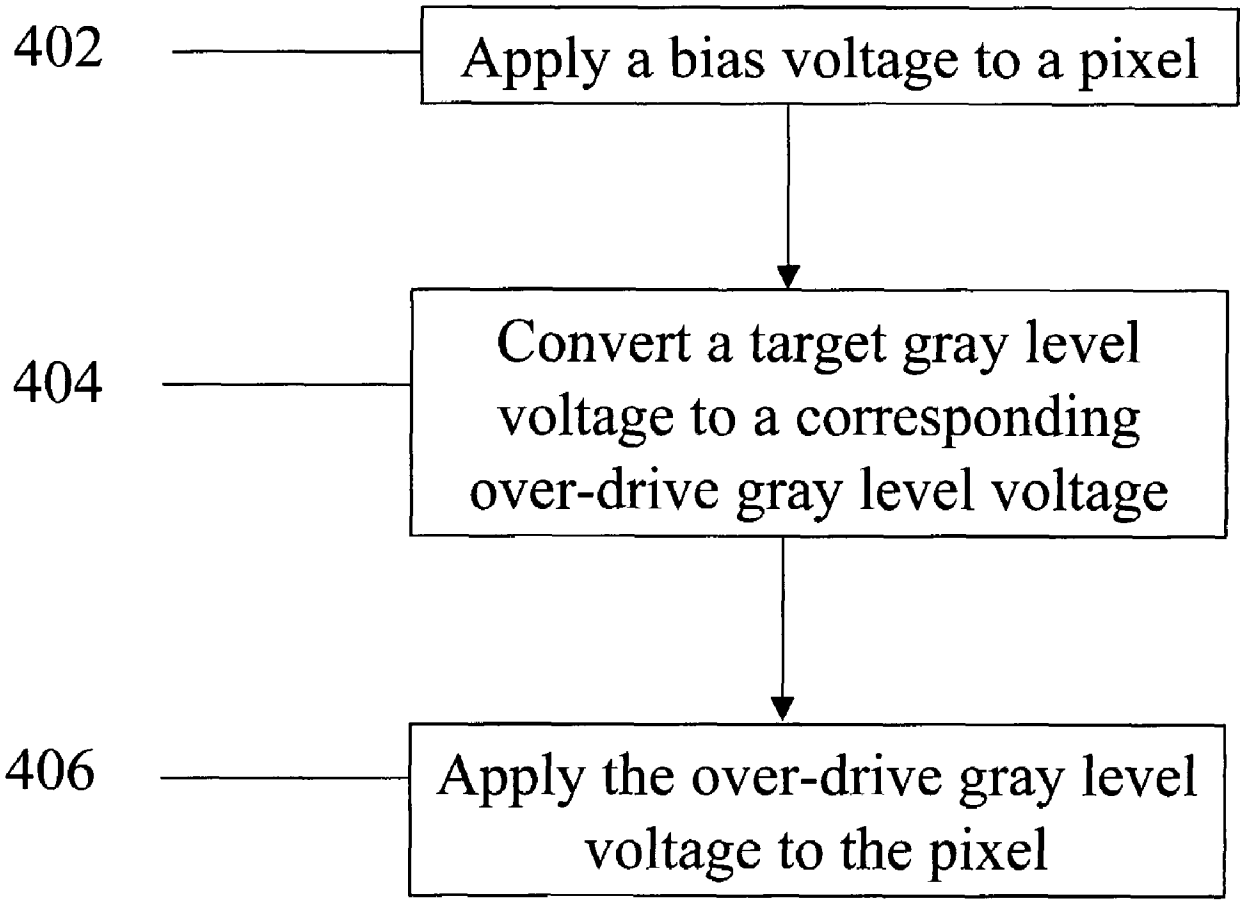
FIG. 4 is a flowchart showing the TFT-LCD driving method according to one preferred embodiment of the present invention.

FIG. 4 demonstrates the TFT-LCD driving method according to one preferred embodiment of the present invention. A bias voltage is first applied to the pixel (step 402), so the gray level displayed by the pixel changes from an initial gray level in a previous frame image to a baseline gray level. Any gray level can be selected as the baseline gray level. For example, in an 8-bits driving system, the baseline gray level can be set to the lowest gray Level $V_0$ or the highest gray Level $V_{255}$. Other appropriate gray level can be selected as the baseline gray level based upon the initial gray level, as long as all pixels return from their respective initial gray level to the same baseline gray level. A target gray level voltage is then retrieved from a image data source, and converted to a corresponding over-drive gray level voltage (step 404). The correlation between the target gray level voltage and the over-drive gray level voltage can be obtained by either a Look-Up Table or a transformation formula. Subsequently, the over-drive gray level voltage is applied to the pixel (step 406) so the gray level displayed by the pixel changes from the baseline gray level to the target gray level.

Figure 5:
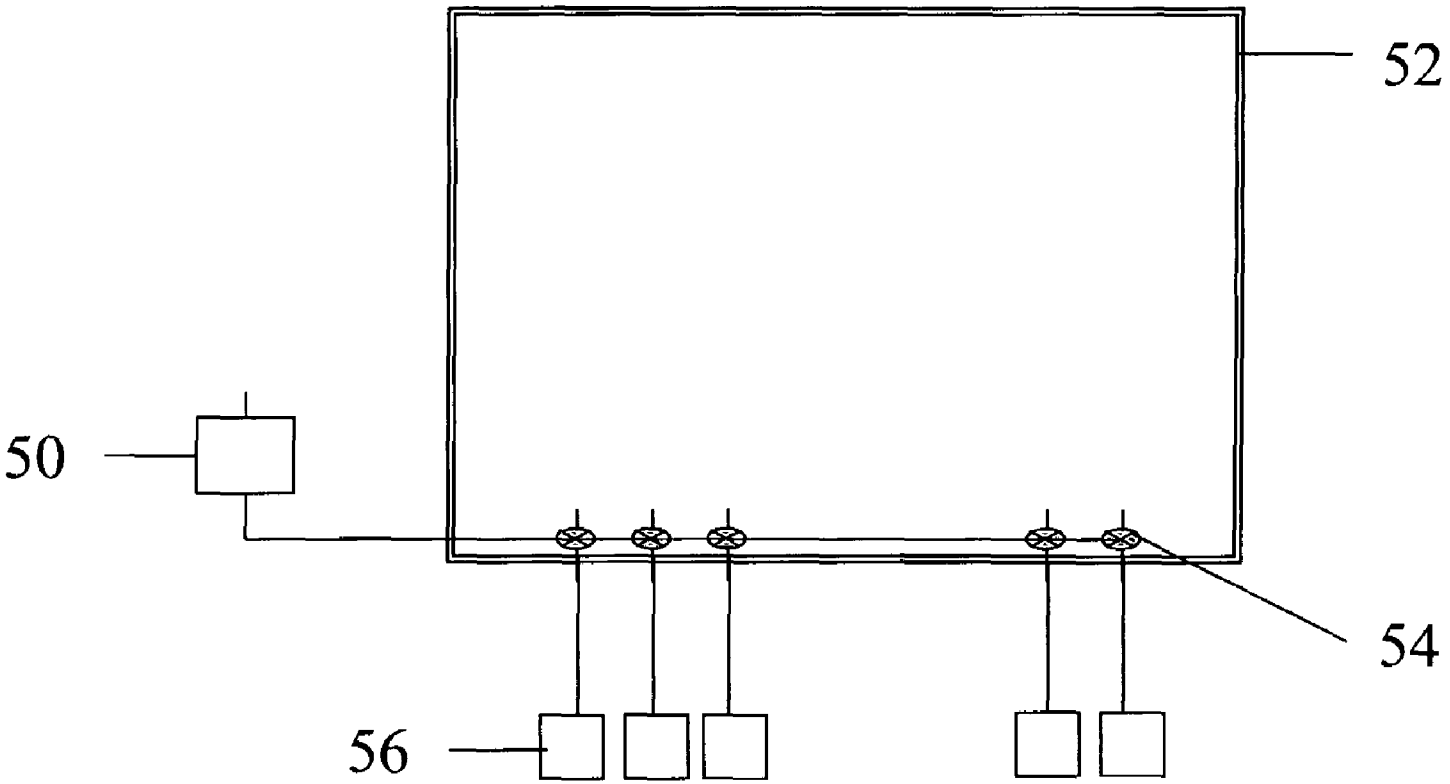
FIG. 5 is a block diagram demonstrating the TFT-LCD driving method according to one preferred embodiment of the present invention.

FIG. 5 is a block diagram illustrating the TFT-LCD driving method according to one preferred embodiment of the present invention. The bias voltage applied to the pixel (step 402) is supplied by an external bias buffer. The external bias buffer 50 is coupled to an output 54 of a source driver 52. When the pixel 56 needs to change from an initial gray level to a baseline gray level, the external bias buffer 50 provides a bias voltage to the output 54 of the source driver 52, so the gray level displayed by the pixel 56 changes from the initial gray level to the baseline gray level.

Moreover, the source driver 52 can provide the bias voltage required for the pixel 56 to return to the baseline gray level itself. By modifying the circuitry of the source driver 52, the bias voltage is supplied to the pixel 56 directly after the source driver 52 provides the initial gray level voltage to the pixel 56 in a previous frame image.

Figure 6:
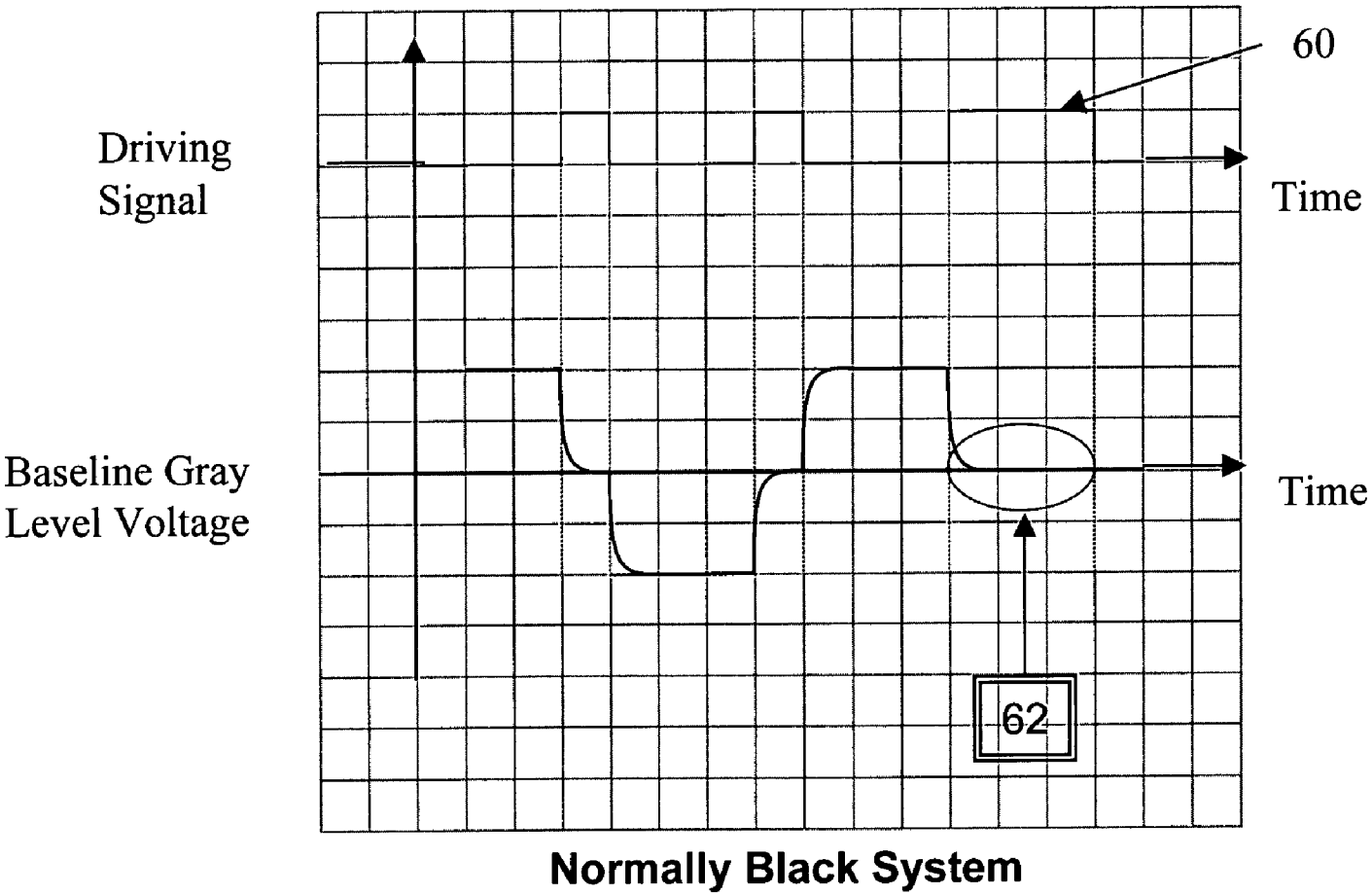
FIG. 6 is a diagram showing the relation between the gray level voltage and time according to one preferred embodiment of the present invention.

FIG. 6 shows the relation between time and the gray level voltage of the pixel in a Normally Black system according to one preferred embodiment of the present invention. During a bias period 60, the external bias buffer 50 provides the bias voltage to the output 54 of the source driver 52. The gray level voltage 62 of the pixel is then biased on the baseline gray level voltage.

Figure 7:
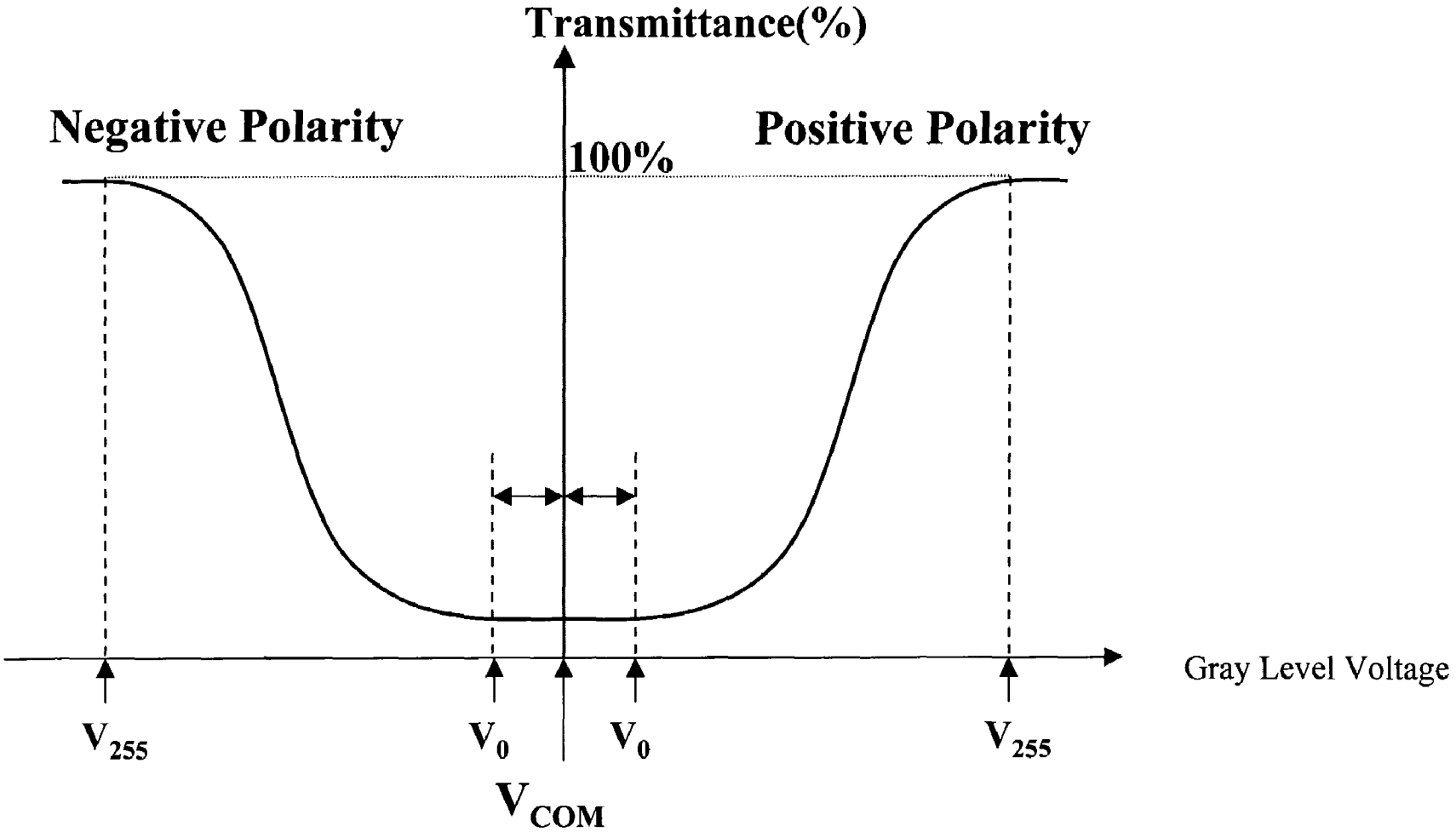
FIG. 7 is diagram showing the relation between the gray level voltage and transmittance in a normally black system according to one preferred embodiment of the present invention.

The bias voltage supplied to the pixel can be equal to the baseline gray level voltage. Alternatively, by employing the over-drive technique again, a bias voltage that is higher or lower than the baseline gray level voltage can be supplied, so the pixel can change from the initial gray level to the baseline gray level more rapidly, FIG. 7 illustrates the relation between the gray level voltage and transmittance of the TFT-LCD in an 8-bits Normally Black system. If the lowest gray Level $V_0$ is selected as the baseline gray level, all pixels are updated to a normally black state after the previous frame image data was written. The external bias buffer 50 provides a common voltage $V_{COM}$ lower than the baseline gray level voltage $V_0$, so the gray level displayed by the pixel can change more rapidly from the initial gray level to the baseline gray Level $V_0$.

Figure 8:
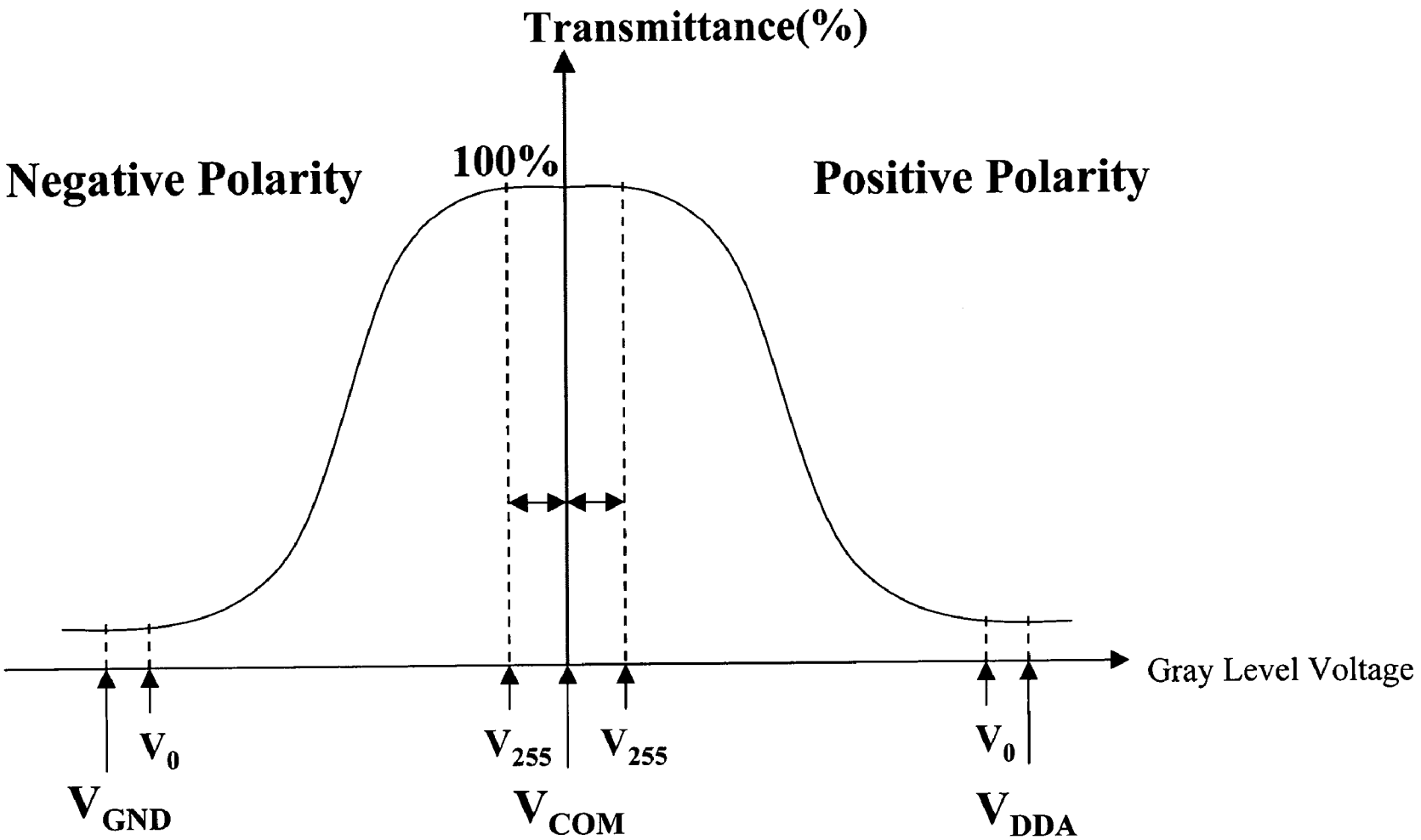
FIG. 8 is a diagram showing the relation between the gray level voltage and the transmittance in a normally white system according to one preferred embodiment of the present invention.

Similarly, the over-drive technique can also be employed in a Normally White system so the pixel can return to the baseline gray level more rapidly. FIG. 8 shows the relation between the gray level voltage and transmittance of the TFT-LCD in an 8-bits Normally White system. If the lowest gray Level $V_0$ is selected as the baseline gray level, in positive polarity, an analog voltage $V_{DDA}$ higher than the baseline gray level voltage $V_0$ is provided as the bias voltage. In negative polarity, a ground voltage $V_{GND}$ lower than the baseline gray level voltage $V_0$ is provided as the bias voltage.

Furthermore, the charge sharing technique can also be employed before applying the bias voltage to the pixel. By applying the charge sharing technique, the gray level voltage of the pixel can return a value that is closer to the baseline gray level voltage. Therefore, the power consumption can further be minimized.

After the gray level displayed by the pixel returns from the initial gray level to the baseline gray level by the bias voltage provided by the external bias buffer 50, a target gray level voltage is retrieved from the image data source and converted to a corresponding over-drive gray level voltage. The over-drive gray level voltage is then applied to the pixel so the gray level displayed by the pixel changes from the baseline gray level to the target gray level.

Figure 9:
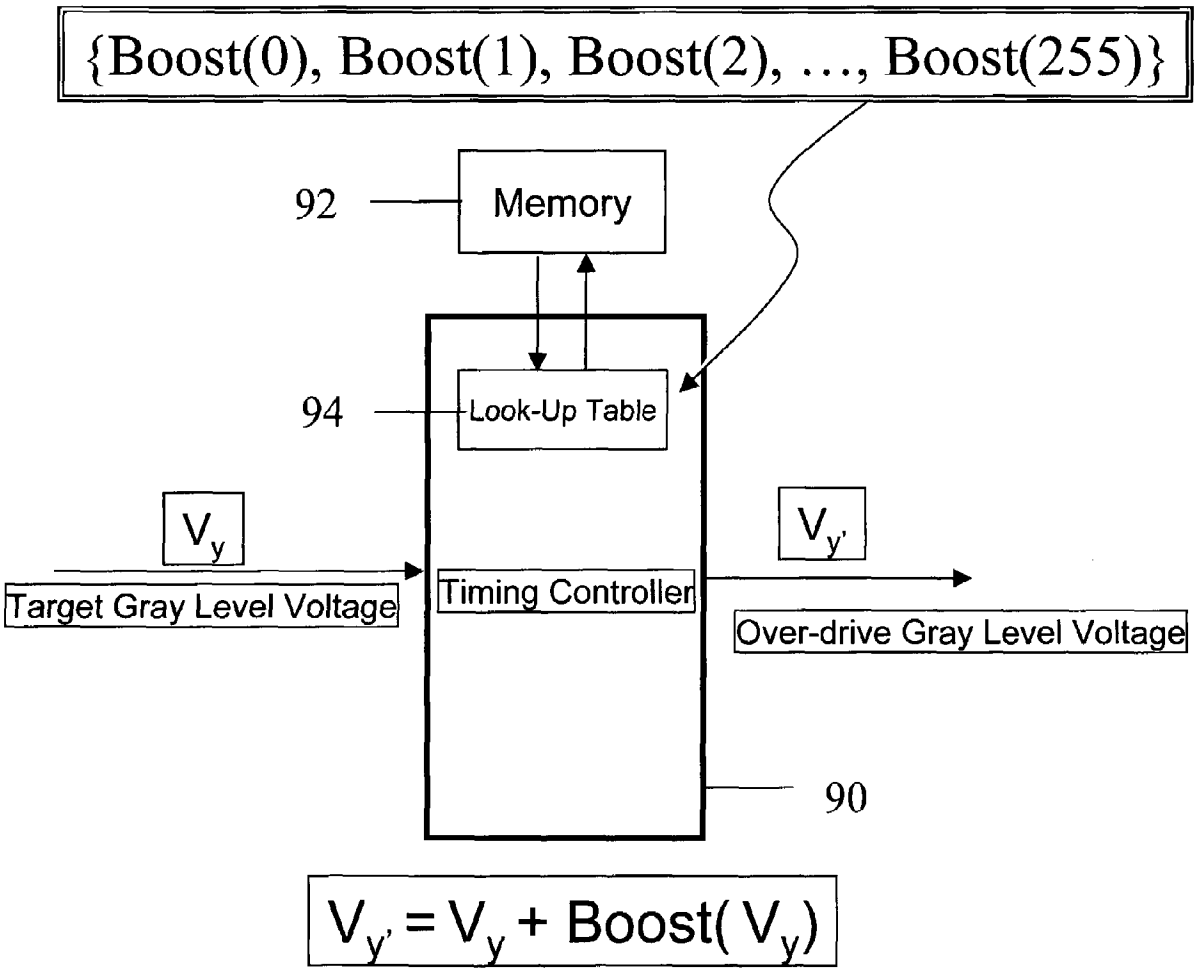
FIG. 9 is a flowchart demonstrating the conversion of a target gray level voltage to a corresponding over-drive gray level voltage according to one preferred embodiment of the present invention.

FIG. 9 is a block diagram demonstrating the conversion of the target gray level voltage to the corresponding over-drive gray level voltage according to one preferred embodiment of the present invention. After the gray level voltage of the pixel changes from the initial gray level to the baseline gray level by the external bias buffer 50, timing controller 90 retrieves a target gray level voltage $V_y$ of next frame image data form a image data source. The timing controller 90 then converts the target gray level voltage $V_y$ to a corresponding over-drive gray level voltage $V_y'$.

One approach to obtain the over-drive gray level voltage $V_y'$ is by directly mapping from a Look-Up Table 94 stored in an EEPROM 92. Since the gray levels displayed by all pixels return to the same baseline gray level, all pixels now change from the same initial gray level (i.e., the baseline gray level) to different target gray levels. Therefore, the correlation between the initial gray level voltage, the target gray level voltage, and the over-drive gray level voltage, can be simplified to only one column of Look-Up Table in the prior art. For example, if the gray level voltage $V_0$ is selected as the baseline gray level voltage, only the first column in the Look-Up Table in FIG. 2 is required for mapping the corresponding over-drive gray level voltage. If the gray level voltage $V_{16}$ is selected as the baseline gray level voltage, only the second column in the Look-Up Table in FIG. 2 is required for mapping. Thus, the Look-Up Table required for mapping can be simplified according to the driving method of the present invention.

Another approach to obtain the over-drive gray level voltage $V_y'$ is by a transformation formula $V_y'=V_y+\text{Boost}(V_y)$ stored in the timing controller 90, where $V_y$ is the target gray level voltage, $V_y'$ is the over-drive gray level voltage, and Boost ($V_y$) is the boost gray level voltage provided by the timing controller 90. The boost gray level voltage Boost ($V_y$) is a function of the target gray level voltage $V_y$.

Figure 10:
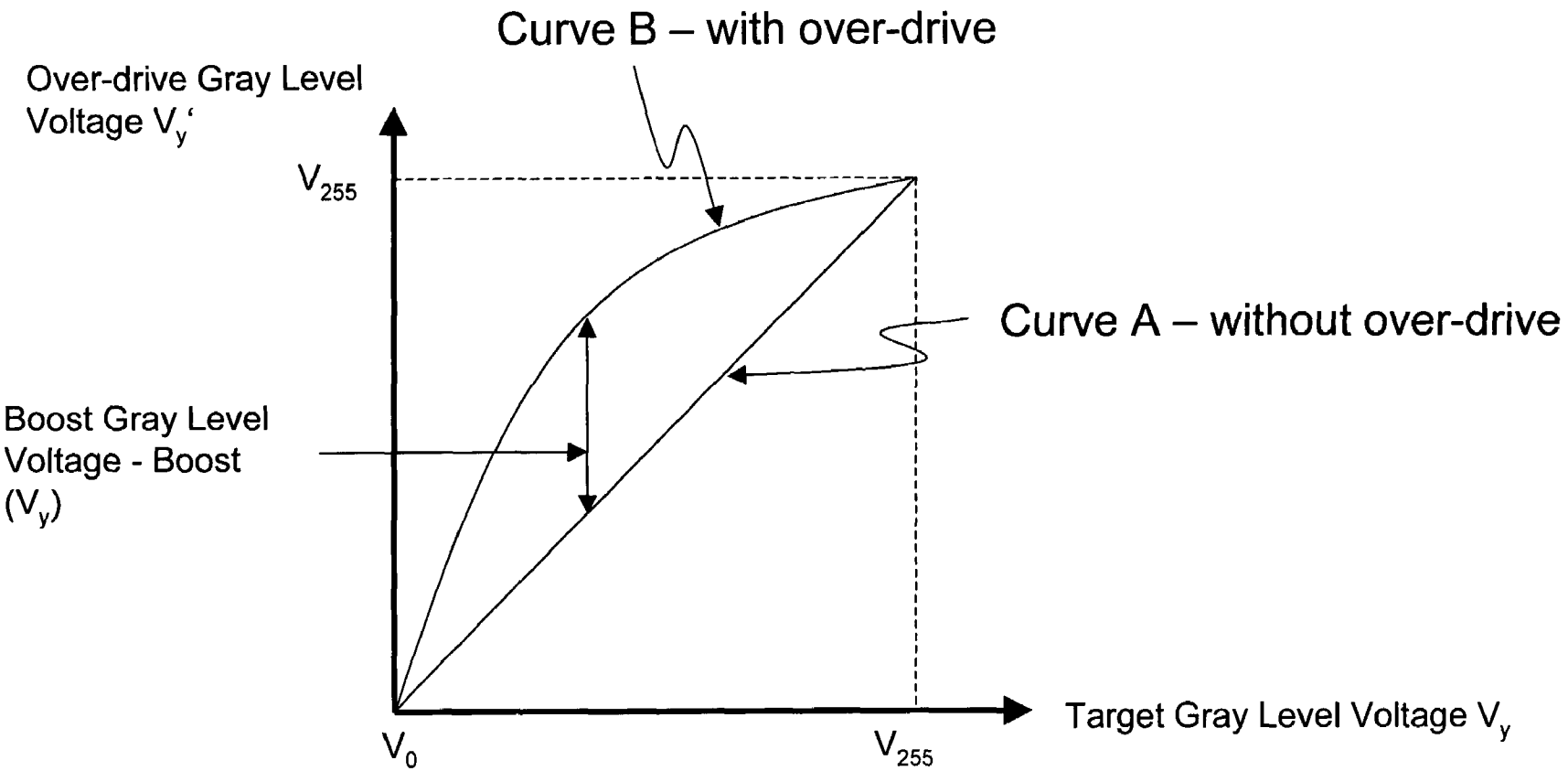
FIG. 10 is a diagram showing the relation between the target gray level voltage and the over-drive gray level voltage according to one preferred embodiment of the present invention.

FIG. 10 further illustrates the relation between the target gray level voltage $V_y$ and the over-drive gray level voltage $V_y'$ according to the above transformation formula. The horizontal axis represents the target gray level voltage $V_y$, and the vertical axis represents the over-drive gray level voltage $V_y'$. Curve A is the plot without using the over-drive technique. In this case, the gray level voltage provided to the pixel is the original target gray level voltage. Curve B is the plot using the over-drive technique. The target gray level voltage $V_y$ is converted to the corresponding over-drive gray level voltage $V_y'$ according to the above transformation formula. The gap between the curve A and curve B in a given target gray level voltage $V_y$ represents the boost gray level voltage Boost ($V_y$).

According to one preferred embodiment of the present invention, the driving method according to the present invention allows the pixel to achieve the desired target gray level more rapidly, and the frame buffer is no longer required in the driving system. Additionally, the memory capacity required for storing the Look-Up Table can be minimized. The overall manufacture cost can be further reduced. Moreover, the present invention can simplify the integrated circuit design and the chip size. The power consumption and the blurring effect can also be minimized. The present invention is particularly suitable for motion picture display.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for driving a TFT-LCD, the TFT-LCD including a plurality of pixels arranged in a number of rows wherein the method comprises: between a previous frame image and a next frame image, applying a common bias voltage to all pixels in each said row so that gray levels of said pixels respectively change from different initial gray levels of the previous frame image to a same baseline gray level; based on the same baseline gray level, converting target gray level voltages for the next frame image to corresponding over-drive gray level voltages; and applying the over-drive gray level voltages to said pixels so that the gray levels of said pixels change from the same baseline gray level to corresponding target gray levels in the next frame image.

2. The method of claim 1, wherein the common bias voltage is supplied by an external bias buffer.

3. The method of claim 1, wherein the common bias voltage is supplied by a source driver.

4. The method of claim 1, wherein the common bias voltage is a common voltage when the baseline gray level is the lowest gray level in a Normally Black system.

5. The method of claim 1, wherein the common bias voltage is an analog voltage in a positive polarity when the baseline gray level is the lowest gray level in a Normally White system.

6. The method of claim 1, wherein the common bias voltage is a ground voltage in a negative polarity when the baseline gray level is the lowest gray level in a Normally White system.

7. The method of claim 1, wherein the step of converting the target gray level voltage to the corresponding over-drive gray level voltage comprises mapping from a Look-Up Table.

8. The method of claim 7, wherein the Look-Up Table is stored in a memory.

9. The method of claim 1, wherein the step of converting the target gray level voltage to the over-drive gray level voltage comprises using a transformation formula.

10. The method of claim 9, wherein the transformation formula is $V_y'=V_y+\text{Boost}(V_y)$, wherein $V_y'$ is the over-drive gray level voltage, $V_y$ is the target gray level voltage, and Boost ($V_y$) is a boost gray level voltage.

11. A TFT-LCD, comprising: a panel including a plurality of pixels arranged in a number of rows; a bias source for applying, between a previous frame image and a next frame image, a common bias voltage to all pixels in each said row so that gray levels of said pixels respectively change from different initial gray levels of the previous frame image to a same baseline gray level; a timing controller for converting, based on the same baseline gray level, target gray level voltages for the next frame image to corresponding over-drive gray level voltages; and a source driver for applying the over-drive gray level voltages to said pixels so that the gray levels of said pixels change from the same baseline gray level to corresponding target gray levels in the next frame image.

12. The TFT-LCD of claim 11, wherein the bias source is an external bias buffer coupling to the source driver.

13. The TFT-LCD of claim 11, wherein the bias source is the source driver.

14. The TFT-LCD of claim 11, wherein the common bias voltage is a common voltage when the baseline gray level is the lowest gray level in a Normally Black system.

15. The TFT-LCD of claim 11, wherein the common bias voltage is an analog voltage in a positive polarity when the baseline gray level is the lowest gray level in a Normally White system.

16. The TFT-LCD of claim 11, wherein the common bias voltage is a ground voltage in a negative polarity when the baseline gray level is the lowest gray level in a Normally White system.

17. The TFT-LCD of claim 11, wherein the timing controller converts the target gray level voltage to the corresponding over-drive gray level voltage by mapping from a Look-Up Table.

18. The TFT-LCD of claim 17, wherein the Look-Up Table is stored in a memory.

19. The TFT-LCD of claim 11, wherein the timing controller converts the target gray level voltage to the corresponding over-drive gray level voltage by using a transformation formula.

20. The TFT-LCD of claim 19, wherein the transformation formula is $V_y' = V_y + \text{Boost}(V_y)$, wherein $V_y'$ is the over-drive gray level voltage, $V_y$ is the target gray level voltage, and Boost $(V_y)$ is a boost gray level voltage.

* * * * *